United States Patent [19]

Beretta

[11] 4,282,795

[45] Aug. 11, 1981

[54] SAFETY FOR AN AUTOMATIC PISTOL

[75] Inventor: Pier C. Beretta, Gardone V.T., Italy

[73] Assignee: Fabbrica d'Armi Pietro Beretta S.p.A., Gardone V.T., Italy

[21] Appl. No.: 943,117

[22] Filed: Sep. 18, 1978

[30] Foreign Application Priority Data

Oct. 28, 1977 [IT] Italy ..... 5240 A/77

[51] Int. Cl.[3] ..... F41C 17/04

[52] U.S. Cl. ..... 89/148; 42/70 F

[58] Field of Search ..... 42/70 R, 70 F; 89/142, 89/147, 148

[56] References Cited

U.S. PATENT DOCUMENTS

| | | | |
|---|---|---|---|
| 2,846,925 | 8/1958 | Norman | 89/148 |
| 3,492,748 | 2/1970 | Swenson | 42/70 R |
| 3,633,303 | 1/1972 | Volkmar et al. | 42/70 F |

*Primary Examiner*—Stephen C. Bentley

[57] ABSTRACT

In an automatic pistol safety means block the firing pin in a neutral position and prevent the lever and the arming rod from cooperating with each other and with the hammer. Automatic safety means intercept and block the hammer to prevent its contact with the firing pin. The firing pin can be immobilized in a neutral position with no possibility of being contacted by the hammer thereby preventing accidental firing of the pistol.

14 Claims, 13 Drawing Figures

Fig. 1
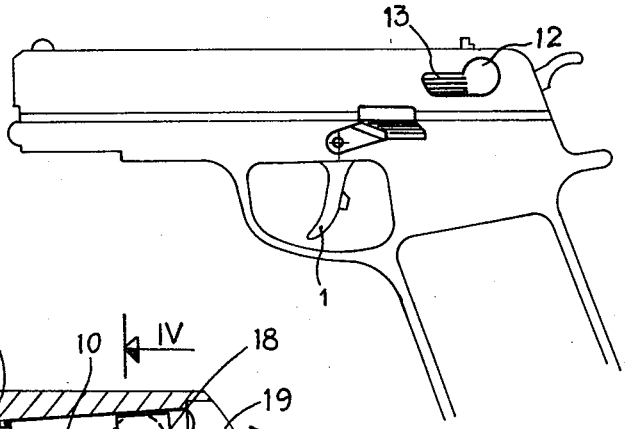
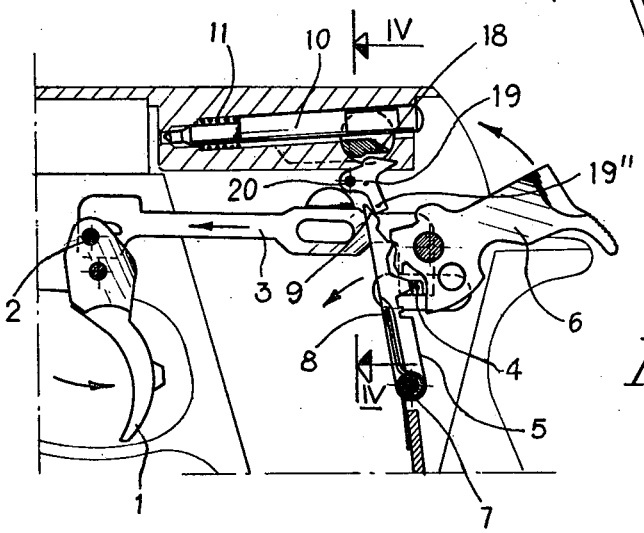
Fig. 2
Fig. 3
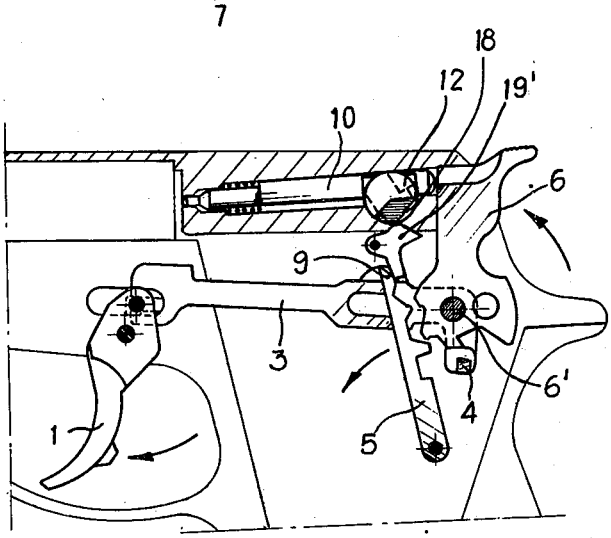
Fig. 13
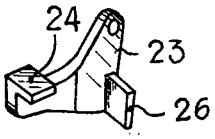

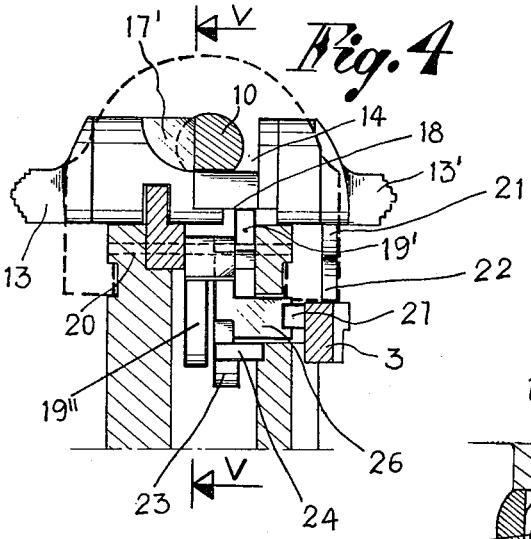
Fig. 4
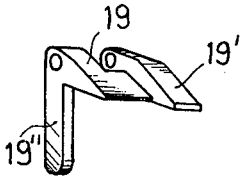
Fig. 12
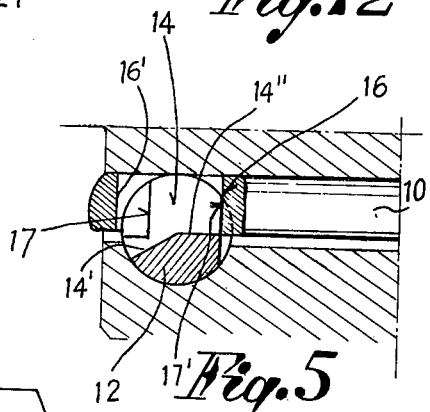
Fig. 5
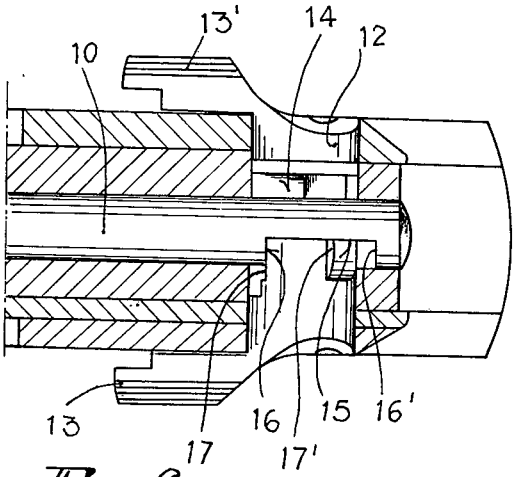
Fig. 6
Fig. 7
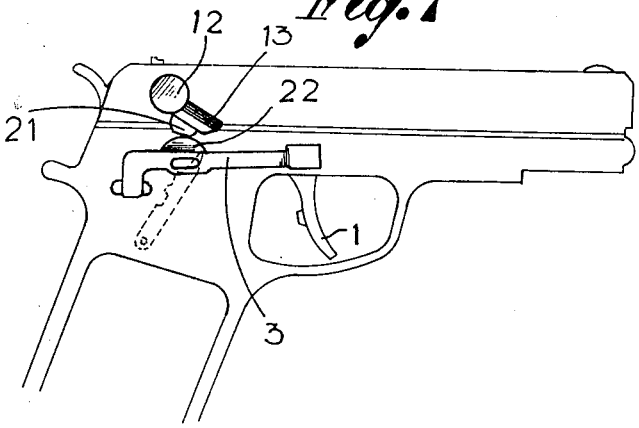

SAFETY FOR AN AUTOMATIC PISTOL

FIELD OF THE INVENTION

The present invention relates to automatic pistols and, more particularly, to improvements in the safety means thereof, so as to prevent the uncontrolled operation and accidental firing of the firearm.

DESCRIPTION OF THE PRIOR ART

In the field of automatic pistols, double safety devices are known, which are capable of a so-called "ordinary" safety, carried out manually and therefore voluntarily, and an "extraordinary" safety, carried out automatically and which is always operational but allows the use of the weapon only under predetermined conditions.

The "ordinary" safety means have been devised in order to block the trigger or the snap lever. The "automatic" safety means, on theother hand, have also been provided heretofore in association with the snap lever. Regardless of the double safety means there is still the danger of accidental firing so that there has always been a demand for more efficient safety means which should act on other elements or components of the pistol.

SUMMARY OF THE INVENTION

It is therefore an object of the present invention to provide an improved automatic pistol which comprises both "ordinary" and "automatic" safety means capable of most rigorously preventing the uncontrolled or accidental firing of the weapon, and also capable of obtaining a degree of safety otherwise not achievable by means of the known devices.

Substantially, the automatic pistol of the present invention comprises "ordinary" safety means, that is manually controlled and capable of engaging on one hand the hammer or firing pin and blocking it in a non-firing or neutral position; and on the other hand capable of engaging the snap lever and the rod connected to the trigger, so as to deactivate the said lever and the said rod. The pistol also comprises automatic safety means capable of intercepting the hammer in the event of accidental disengagement thereof.

BRIEF DESCRIPTION OF THE DRAWINGS

Greater details of the device of the present invention will be given hereafter in the description thereof with reference to the accompanying drawings in which:

FIG. 1 is an overall side elevational view of a pistol of the present invention;

FIG. 2 is a fragmentary schematic elevational view partially in section of the assembled percussion mechanism of the present invention;

FIG. 3 is a view similar to FIG. 2, but illustrating a position of safety;

FIG. 4 is a transverse sectional elevational view taken in the direction of the arrows IV—IV of FIG. 2;

FIG. 5 is a sectional elevational view taken in the direction of arrows V—V of FIG. 4;

FIG. 6 is a fragmentary top plan view partially in section of the firing pin coupled with the safety mechanism of the present invention;

FIG. 7 is a side elevational view of the pistol taken from the side of the disengagement rod;

FIG. 12. is a perspective view of the lever for the manually operation safety means; and FIG. 13 is a perspective view of the lever for the automatic safety means.

DETAILED DESCRIPTION OF THE INVENTION

Figure 8:
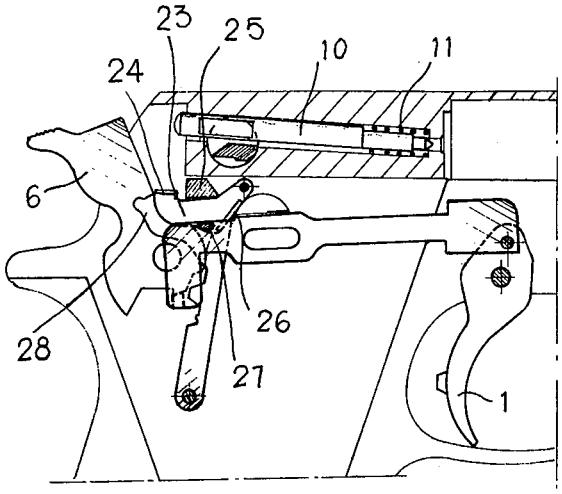
FIG. 8 is a fragmentary sectional side elevational view showing the lever for the automatic safety in a position capable of intercepting the hammer in the event of accidental disengagement thereof.
Figure 9:
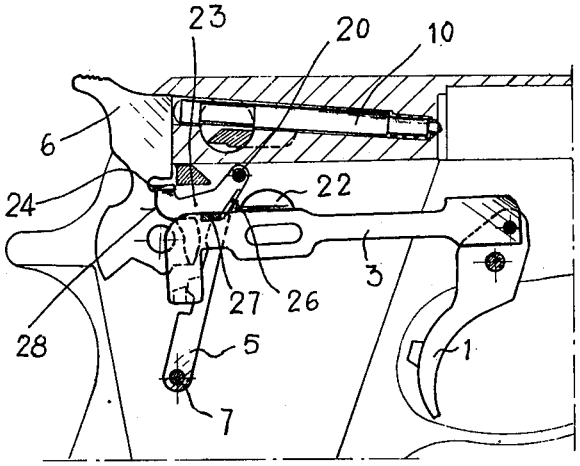
FIG. 9 is a view similar to FIG. 8 but with the lever in inactive position.
Figure 10:
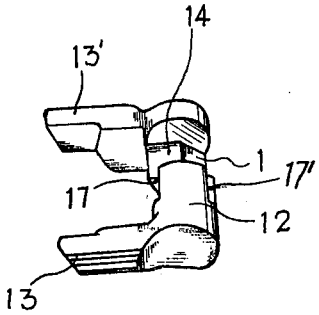
FIG. 10 is a perspective view of the disengagement rod of the present invention.
Figure 11:
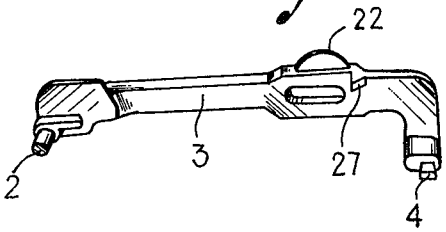
FIG. 11 is a perspective view of the arming rod comprising the present invention.

Referring now to the drawings, to the trigger 1 of the pistol there is attached, by means of a pin 2, one extremity of the arming rod 3. The other or opposite extremity of the rod 3 has a tappet or catch 4 which controls, in a manner known per se, a lever 5, which engages and disengages a hammer 6 and the hammmer 6 itself, by means of a double action. In fact the lever 5 pivots proximate its lower end on a pin 7. The lever 5 is engaged by a spring 8 which tends to keep it displaced toward the hammer. At its upper end, the lever 5 has a free extremity 9. The hammer 6 is pivoted at 6' and, when armed and disengaged from the lever 5 or controlled by the double action of the rod 3, hits against the firing pin 10 which is biased by a spring 11 that normally keeps it displaced toward the back in a non-operative position.

The functioning or operation of the percussion mechanism of the pistol is well known and in need, therefore of no description or particular attention. What is, instead, characteristic of the present invention is the mechanism for having the pistol in a safety condition when it is not being used and for the prevention of the weapon's uncontrolled or accidental firing.

According to the invention, the safety mechanism comprises a cam shift 12 mounted transversely, but arranged for angular displacements, within the body of the breechblock, and provided with a pair of laterally spaced apart end levers 13–13', one on each side, for the ambidextrous control thereof.

The cam shaft 12 is adjacent to and extends in a substantially transverse direction with respect to the longitudinal axis of the firing pin or striker 10. In the intermediate portion of the cam shaft 12 there is provided a U-shaped slot or seat 14 in which there is displaceably positioned the firing pin or striker 10. The base of the seat 14 is preferably formed by two planes or surfaces 14' and 14'' having a common junction but being at different angles. The firing pin or striker 10, in turn, has in the intermediate portion thereof, a lateral , axially extending slot 15 which defines two parallel shoulder 16–16' opposite each other and spaced by a distance equal to or slightly greater than the diameter of the cam shaft 12.

Aligned with the shoulders 16–16' of the firing pin or striker 10, on the cam shaft 12, there are provided two lateral planes 17–17, one on each side, for reducing in that particular area the thickness of the shaft 12 and permitting the linear displacements of the striker 10 with respect to the shaft itself.

In the lower part of the cam shaft 12 there is a cam surface 18 that cooperates with the upper arm 19' of an inverted L-shaped lever 19, pivoted on a pin 20 for effecting angular displacements of the lever 19 and for thereby causing engagement of the other arm 19" of the lever 19 with the free, upper extremity 9 of the lever 5.

When the shaft 12 is rotated to the position that permits the free displacement of the striker 10, cam surface 18 has not effect on the lever 19. However, the lever 19, due to the action of the lever 5 that is engaged by the spring 8 is rotated so as to have its upper arm 19' displaced upwardly, as shown in FIG. 2 of the drawings. The function of the lever 19, when actuated by the cam surface 18 of the shaft 12, will be explained and clarified later on.

The cam shaft 12 has, furthermore, beneath its control lever 13', which is positioned on the side of the arming rod 3, a projection 21 which is aligned with a cam surface 22 provided on the rod 3—see FIGS. 4 and 7. The projection 21 acts on the said cam surface 22 so as to displace the rod 3 to a non-operative position, when the cam shaft 12 is rotated in a way as to obtain a safety position.

The mechanism hereinabove described is completed by a lever 22 which constitutes an automatic safety-means and which serves the function of intercepting and blocking the hammer 6 in the event of accidental disengagement, when in armed position.

For this purpose, the lever 23 is freely pivoted, in a pendulum-like manner on the same pin 20 on which is pivoted the lever 19.

The lever 23 has, at one extremity thereof, a tappet or catch 24 facing toward the hammer 6 and so as to be positioned laterally between the forward face of the hammer 6 and a fixed shoulder 25 of the pistol. The lever 23 further includes a laterally extending arm 26 which is faced toward the arming rod 3 and is positioned in front of a control tooth 27 provided on the upper surface of the rod 3.

The lever 23 is actuated by a spring (not shown) which normally keeps the lever 23 angularly displaced so that the catch 24 is at such a height as to interpose itself between the hammer 6 and the fixed shoulder 25. The tooth 27 of the rod 3, acting against the lateral arm 26, causes the lever 23 to move in a direction opposite to the direction of the spring, so that the catch 24 is displaced to a lower position where it does not intercept the hammer 6, that is, in correspondence with a recess 28 provided in the hammer 6 itself.

Substantially, the automatic safety means of the pistol, comprising of the lever 23 works as follows:

When the hammer 6 is unarmed and the trigger 1 is in a resting position, the rod 3 is fully pulled back and tooth 27 is spaced from arm 26 of the lever 23. The catch 24 of the lever 23 is, instead, in correspondence with the recess 28 of the hammer 6 and is blocked in this postion by the upper portion of the recess 28. With the displacement of the hammer 6 to the armed positioned, the lever 23, after the catch 24 is freed from the recess 28, rotates and brings the catch 24 into the plane of interception with the hammer 6, while the trigger 1 becomes "armed" by displacement of ther rod 3, the tooth 27, of which approaches the arm 26 without however moving it.

In this condition, if the hammer 6 becomes disengaged accidentally, such as due to a sudden push or fall of the weapon, without the trigger being touched, the hammer 6 will hit against the arm 26 of the lever 23 without hitting however the firing pin or striker 10. In this manner, one can absolutely prevent the firing of the cartrige positioned in the barrel.

To operate regularly the pistol, it is necessary to actuate the trigger 1, in order to obtain the disengagement of the hammer 6. In this case, the displacement of the trigger 1 determines the displacement of the rod 3, which on one hand determines, with its respective catch 4, the disengagement of the lever 5 to free the hammer 6 and on the other hand acts, by means of the tooth 27, on the arm 26 so as to move the lever 23 to the position where the catch 24 thereof is in alignment with the recess 28 of hammer 6 so as not to interfere with the displacement of the hammer 6 toward the firing pin or strike 10. In this condition, there is a normal and voluntary firing.

To apply the manual safety means, when the pistol is laid down or not in use, one acts on one of the lever 13 or 13' of the cam shaft 12, so as to partially rotate the cam shaft. With the rotation of the cam shaft 12, one obtains, in a first stage, the safety positioning of the striker 10 and, in a second stage, the safety positioning of the rod 3 and of the lever 5, with the resulting automatic disengagement of the hammer 6, when the latter happens to to still armed and without accidental firing of the weapon, because the striker 10 has been preventively placed in the safety position. The safety positioning of the striker 10 is achieved by the partial rotation of the shaft 12, so that, while the planes 17–17' move angularly away from the shoulders 16–16' of the striker 10, there is provided between the shoulders 16–16' a cylindrically shaped region of the engaging pivot or pin (because of its diameter) concurrently against both shoulders. More particularly, the provision of the cylindrical region of the cam shaft 12 between the shoulders 16–16' of the striker 10, determines a slight forward displacement of the stirker 10 so that its rear extremity becomes displaced inwardly of its guide seat with respect to the upper surface of the striker as shown in FIG. 3.

As a result, therefore, the hammer 6 is completely prevented from contacting the firing pin 10, so that the latter cannot be actuated by the hammer 6 and cannot fire the weapon.

When the firing pin 10 is placed in the safety positioned by the angular displacement of the shaft 12, the projection 21 acts on the cam surace 2 of the arming rod 3 so as to lower the rod 3 and to bring its catch 4 into a non-intercepting plane with the hammer 6. At the same time, the cam surface 18 of the arming rod 3 acts on the upper arm 19' and the lever 19, displacing it so that its lower arm 19' acts against the upper extremity of the lever 5 to displace it to a position where it is disengaged from the hammer 6 and does not interfere with it as shown in FIG. 3.

In these conditions of safety, the trigger 1 and the arming rod 3 can be moved freely without acting on any element of the pistol. The lever 5 is displaced and kept in a non-operative position; the firing pin 10 is immobilized in a neutral position with no possibility of being acted upon by the hammer 6; and the hammer 6 itself cannot be armed. As a result, the pistol cannot be used at all and cannot fire even accidentally until one reestabilishes the conditions of normal operation, by acting on one of the levers 13–13' to rotate the shaft 12 in a contrary direction so as to free the firing pin 10, the lever 5 and the arming rod 3 and reactivate them.

What is claimed is:

1. In an automatic pistol which includes a trigger, an arming rod connected at one of its ends to said trigger, a lever pivoted for angular displacements and cooperating with the other extremity of said rod, a hammer attached in an armed position to said lever and detached therefrom by means of said rod, and a firing pin having a rear extremity which is acted upon by said hammer, the improvement comprising:

(a) manually-actuated safety means for blocking said firing pin in a neutral position and for deactivating said lever and said rod so that said lever and said rod cannot cooperate with each other and with said hammer; and (b) automatic safety means for intercepting and blocking said hammer to prevent its contact with said firing pin, wherein said automatic safety means comprises a pendulum-like lever having a terminal tappet facing said hammer and having a lateral arm facing said arming rod so as to be in front of and cooperating with a tooth provided on said rod; said pendulum-like lever being actuated by a spring so as to keep it in the position wherein said tappet is interposed between the hammer and a stationary shoulder integral with the pistol; said tooth of said arming rod displacing said pendulum-like lever in an opposite direction when said hammer is disengaged.

2. The pistol according to claim 1, wherein said manually-actuated safety means comprises a cam shaft that is angularly displaceable and transversely positioned with respect to said firing pin; a pair of levers fixed to the extremities of said shaft for its ambidextrous operation; said shaft having a U-shaped slot in which said firing pin extends and moves; and a pair of planes diametrically opposite and adjacent said slot so as to reduce the thickness of said shaft with respect to its diameter, said planes cooperating with a pair of corresponding shoulders defined by a lateral slot provided on said firing pin for the purpose of defining the axial movements of said firing pin.

3. The pistol according to claim 2, wherein said shoulders defined by said lateral slot of the firing pin are spaced from said other by an amount equal at least to the diameter of the shaft and greater than the thickness of said shaft at the planes thereof.

4. The pistol according to the claim 2, wherein said shaft is angularly displaceable with respect to said firing pin so as to align said planes with said shoulders of said firing pin thus enabling the use of the firing pin and a cylindrical portion of the shaft, intermediate said shoulders, to deactivate said firing pin.

5. The pistol according to claim 2, wherein in the lower portion of said shaft there is a cam surface and an inverted, L-shaped lever pivoted on the body of the pistol and having an upper arm adjacent to said cam surface and a lower arm contacting and engaging said lever; said cam surface determining the displacements of said inverted, L-shaped lever to deactivate said lever with respect to said hammer.

6. The pistol according to claim 2, wherein said shaft inclues a projection that coincides with a cam surface provided on said arming rod; said projection acting, upon rotation of said shaft on said cam surface to deactivate said arming rod with respect to both said lever and said hammer.

7. The pistol according to claim 1, wherein the deactivation of said firing pin occurs prior to the deactivation of said lever and of said arming rod, said deactivation of said lever determining the disengagement of said hammer and the preventing of said cocking of said hammer.

8. The pistol according to claim 1 wherein the hammer has a recess therein for receiving said tappet of said pendulum-like lever when said pendulum-like lever is displaced when said hammer is disengaged by said trigger.

9. In an automatic pistol which includes a trigger, an arming rod connected at one of its ends to said trigger, a lever pivoted for angular displacements and cooperating with the other extremity of said rod, a hammer attached in an armed position to said lever and detached therefrom by means of said rod, and a firing pin the rear extremity of which is acted upon by said hammer, the improvement comprising:

(a) manually-actuated safety means for blocking said firing pin in a neutral position and for deactivating said lever and said rod so that said lever and said rod cannot cooperate with each other and with said hammer, said manually actuated safety means comprising a cam shaft that is angularly displaceable and transversely positioned with respect to said firing pin; a pair of levers fixed to the extremities of said shaft for its ambidextrous operation; said shaft having a U-shaped slot in which said firing pin extends and moves; and a pair of planes diametrically opposite and adjacent said slot so as to reduce the thickness of said shaft with respect to its diameter, said planes cooperating with a pair of corresponding shoulders defined by a lateral slot provided on said firing pin for the purpose of defining the axial movements of said firing pin, in the lower portion of said shaft there being provided a cam surface and an inverted, L-shaped lever pivoted on the body of the pistol and having an upper arm adjacent to said cam surface and a lower arm contacting and engaging said lever, said cam surface contacting and engaging said lever; said cam surface determining the displacements of said inverted, L-shaped lever to deactivate said lever with respect to said hammer, and (b) automatic safety means for intercepting and blocking said hammer to prevent its contact with said firing pin, said automatic safety means comprising a pendulum-like lever having a terminal tappet facing said hammer, and with a lateral arm facing said arming rod so as to be in front of and cooperating with a tooth provided on said rod; said pendulum-like lever being actuated by a spring so as to keep it in the position wherein said tappet is interposed between the hammer and a stationary shoulder integral with the pistol; said tooth of said arming rod displacing said pendulum-like lever in an opposite direction when said hammer is disengaged, said pendulum like lever being pivoted on the same pin as the inverted L-shaped lever.

10. The pistol according to claim 9, wherein said shoulders defined by said lateral slot of the firing pin are spaced from each other by an amount equal at least to the diameter of the shaft and greater than the thickness of said shaft at the planes thereof.

11. The pistol according to claim 9, wherein said shaft is angularly displaceable with respect to said firing pin so as to align said planes with said shoulders of said firing pin thus enabling the use of the firing pin and a cylindrical portion of the shaft, intermediate said shoulders, to deactivate said firing pin.

12. The pistol according to claim 9, wherein said shaft includes a projection that coincides with a cam surface provided on said arming rod; said projection acting, upon rotation of said shaft, on said cam surface to deactivate said arming rod with respect to both said lever and said hammer.

13. The pistol according to claim 9, wherein the deactivation of said firing pin occurs prior to the deactivation of said lever and of said arming rod, said deactivation of said lever determining the disengagement of said hammer and the preventing of the cocking of said hammer.

14. The pistol according to claim 9, wherein the hammer has a recess therein for receiving said tappet of said pendulum-like lever when a pendulum-like lever is displaced when said hammer is disengaged by said trigger.

* * * * *